US009376801B1

(12) United States Patent
Warren et al.

(10) Patent No.: US 9,376,801 B1
(45) Date of Patent: Jun. 28, 2016

(54) MODULAR DEPLOYMENT OF GAS COMPRESSION FACILITIES

(71) Applicant: Solar Turbines Incorporated, San Diego, CA (US)

(72) Inventors: Martin Lewis Warren, Tomball, TX (US); Steven Wayne Moore, Sour Lake, TX (US); Jeffrey James Jaffurs, Tomball, TX (US); Marcel van der Stok, The Woodlands, TX (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 14/689,629

(22) Filed: Apr. 17, 2015

(51) Int. Cl.
*F01K 15/00* (2006.01)
*E04B 1/348* (2006.01)

(52) U.S. Cl.
CPC ..... *E04B 1/34815* (2013.01)

(58) Field of Classification Search
CPC ..... E04B 1/34815; F01K 15/00; F02C 7/236; F16D 1/04
See application file for complete search history.

(56) References Cited

U.S. PATENT DOCUMENTS 2,443,054 A * 6/1948 Putz ..... F01D 25/28 60/797
2,615,615 A * 10/1952 Young ..... F04D 29/063 137/255
2,924,894 A * 2/1960 Hellund ..... F17D 1/00 434/126
3,116,086 A * 12/1963 Barengoltz ..... B60P 3/00 280/837
3,453,443 A * 7/1969 Stoeckly ..... F02C 6/02 290/2
3,536,928 A * 10/1970 Jones, Jr. ..... F02B 63/04 290/1 B
3,791,682 A * 2/1974 Mitchell ..... F02C 7/20 290/1 R
3,925,679 A * 12/1975 Berman ..... E04B 1/3483 290/1 R
4,132,535 A * 1/1979 Rivers, Jr. ..... B01D 51/00 137/13
4,136,432 A * 1/1979 Melley, Jr. ..... B60P 3/00 29/469
4,469,954 A * 9/1984 Maehara ..... H02B 1/52 290/1 A
5,517,822 A * 5/1996 Haws ..... F01K 17/025 122/1 R
5,675,194 A * 10/1997 Domigan ..... H02G 3/00 174/50
6,393,775 B1 * 5/2002 Staschik ..... C02F 9/00 210/170.08
6,450,133 B1 * 9/2002 Bernard ..... F01P 5/04 123/2
6,625,937 B1 9/2003 Parker et al.
6,765,304 B2 * 7/2004 Baten ..... F02B 63/04 290/1 A
6,877,581 B2 * 4/2005 Badr ..... B60P 3/00 180/311
7,143,585 B2 * 12/2006 Kuroki ..... F01D 25/285 60/797
7,221,061 B2 * 5/2007 Alger ..... F02B 63/04 290/1 A
7,461,510 B1 * 12/2008 Munson, Jr. ..... F01D 15/10 60/796
7,827,738 B2 11/2010 Abrams et al.
8,047,809 B2 11/2011 Wickert et al.
8,167,584 B2 5/2012 Pyke et al.
8,198,966 B2 * 6/2012 Thrue ..... E04H 5/04 336/107
8,221,626 B2 * 7/2012 Sassow ..... C12M 21/04 210/173
8,450,863 B2 * 5/2013 Farr ..... H02B 1/00 174/17 R
8,587,136 B2 * 11/2013 Williams ..... F01K 13/00 290/1 A
2011/0094261 A1 4/2011 Wilding et al.
2013/0233388 A1 9/2013 Utal et al.

* cited by examiner

*Primary Examiner* — Jeanette E Chapman
(74) *Attorney, Agent, or Firm* — Procopio, Cory, Hargreaves & Savitch LLP

(57) ABSTRACT

A method of deploying a modular gas compression plant is disclosed. In an embodiment, the method comprises constructing a building of four substructures including a first lower housing, a first upper housing, a second lower housing, and a second upper housing. The method further includes assembling a turbomachinery equipment into the first lower housing. The method further includes assembling an air inlet duct and an exhaust duct to the first upper housing. The method further includes disassembling the building into the four substructures.

17 Claims, 5 Drawing Sheets

MODULAR DEPLOYMENT OF GAS COMPRESSION FACILITIES

TECHNICAL FIELD

The present disclosure generally pertains to gas compression plants, and is more particularly directed toward a modular construction and deployment of a gas compression plant.

BACKGROUND

Gas compression plants transport natural gas from one location to another location. Gas compression plants are usually constructed near the site. Construction of the gas compression plant may require a substantial amount of labor and time, especially in certain regions of the world. Modular construction and deployment of a gas compression plant can reduce startup delays, save on labor costs, and ensure optimum operability.

U.S. Patent Publication No. 2013/0233388 to D. Utal, et al., discloses a compression system deposed in a container and shipped to a location having a supply of natural gas. The compression system connects to the natural gas supply, compresses gas from the supply, and provides compressed gas to a consumer. The container, which can be standardized ISO shipping container, is fitted with removable vents at designated locations. Strategic positioning of compression system components in combination with the removable vents allows for ready access to the compression system for repair and maintenance.

The present disclosure is directed toward overcoming one or more of the problems discovered by the inventors.

SUMMARY OF THE DISCLOSURE

A method of deploying a modular gas compression plant is disclosed. In an embodiment, the method comprises constructing a building of four substructures. The four substructures include a first lower housing having a plurality of turbomachinery equipment guide features, a first upper housing having a plurality of turbomachinery equipment guide features, a second lower housing having a long platform within the maintenance building lower housing, and a second upper housing having a gas processing apparatus. The method further includes assembling a turbomachinery equipment coupled to a compressor into the first lower housing. The method further includes assembling an air inlet duct and an exhaust duct to the first upper housing. The method further includes assembling a network of conduits coupling the building to the gas processing structure. The method further includes shipping the compressor building lower housing, the compressor building upper housing, the maintenance building lower housing, the maintenance building upper housing, the local equipment room, the process separation and valve skid, the maintenance access platform, interconnecting pipe skid, and the process gas cooler skid each on their own separate transportation apparatus.

DETAILED DESCRIPTION

The systems and methods disclosed herein include a method for deploying a modular gas compression plant. The method may include constructing and deploying a building for operating gas compression equipment such as a gas turbine engine coupled to a compressor. The building may be constructed in four substructures which can be connected together. Some of the substructures may include turbomachinery equipment guide features designed to accommodate turbomachinery. Each of the substructures may be transported on a single transportation apparatus. Other equipment and components may be shipped to and assembled at a designated site to facilitate gas compression.

Figure 1:
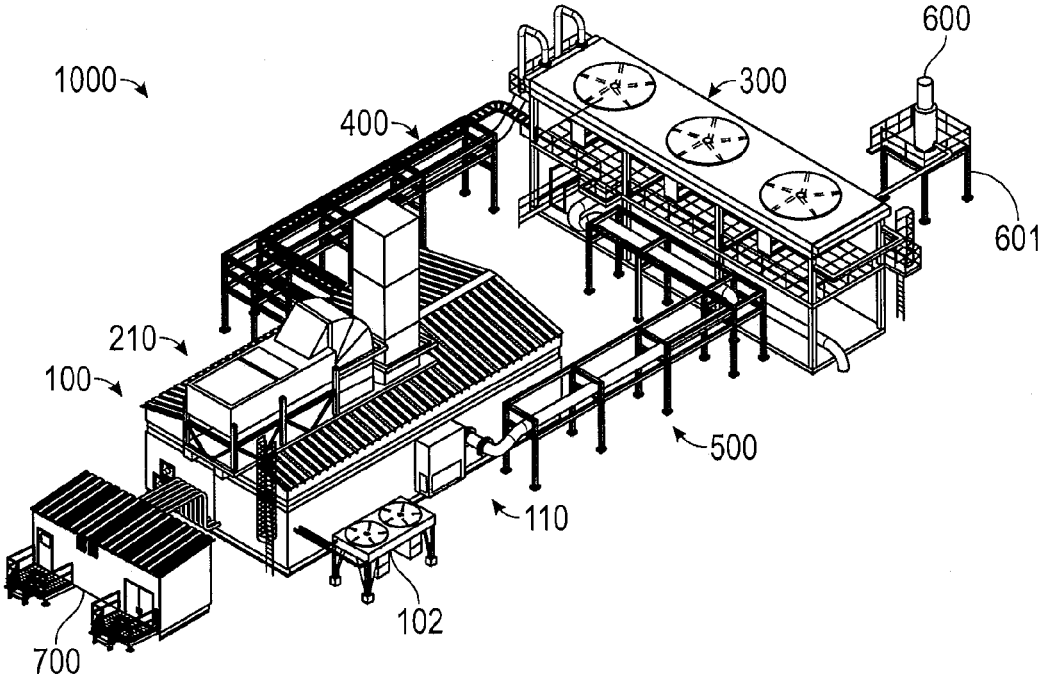
FIG. 1 is a perspective view of an embodiment of a modular gas compression deployment plant.

FIG. 1 is an illustration of an exemplary modular gas compression plant 1000 (sometimes hereinafter referred to as gas compression facility). Some of the surfaces have been left out or exaggerated (here and in other figures) for clarity and ease of explanation.

The gas compression plant 1000 may include a plurality of structures and components. Such structures, for example, may be an operations building 100, a gas processing structure 300, and a local equipment room 700. Operations building 100 may be divided into two substructures: a compressor building 110 and a maintenance building 210. Gas compression plant 1000 may also include various components that facilitate gas compression or gas delivery such as a compressor suction pipe and rack 400, a compressor discharge pipe and rack 500, and a blowdown silencer module 600.

Figure 2:
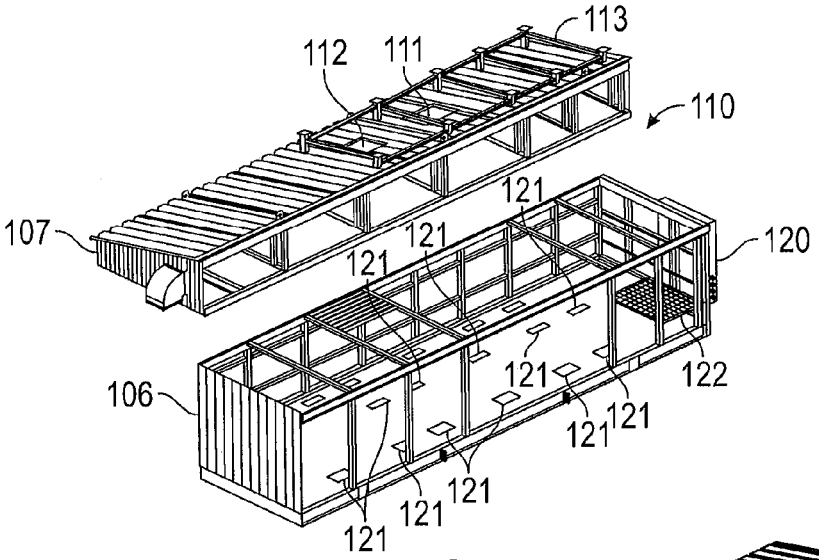
FIG. 2 is an exploded view of a compressor building.

FIG. 2 is an exploded view of a compressor building 110. As shown, compressor building 110 may be split into two individual substructures, such as a compressor building lower housing 106 (sometimes referred to as first lower housing) and a compressor building upper housing 107 (sometimes referred to as first upper housing). Compressor building lower housing 106 may be a structure composed of panels forming at least three walls. Further, compressor building lower housing 106 may be built to support turbomachinery equipment such as a gas turbine engine and a compressor. In some embodiments, the dimensions of compressor building lower housing 106 ranges from 35'L×12'W×12'H to 60'L×17'W×13.5'H. Compressor building lower housing 106 may weigh from 10 short tons to 40 short tons. Compressor building upper housing 107 may be a roof structure composed of panels forming at least three walls in which one of the walls is a sloped ceiling. The dimensions of compressor building upper housing 107 may range from 35'L×12'W×3'H to 60'L×17'W×7'H. In certain embodiments, compressor building lower housing 106 and compressor building upper housing 107 are combined to form one half of operations building 100 (shown in FIG. 1). In certain embodiments, this half of operations building 100 is referred to as the compressor building 110 or first substructure 110.

In particular instances, compressor building lower housing 106 and compressor building upper housing 107 are each constructed with customizable features to accommodate turbomachinery such as a gas turbine engine and a compressor. These features may be referred to as turbomachinery equipment guide features. In some embodiments, compressor building lower housing 106 and compressor building upper housing 107 are each constructed to accommodate a gas turbine engine and a generator or a mechanical drive system. Compressor building lower housing 106 and compressor building upper housing 107 may be customized to accommodate a wide range of turbomachinery components and subcomponents.

For example, compressor building lower housing 106 may include a plurality of support points 121. Support points 121 may be a small structural object configured to install the base of a turbomachinery device such as a gas turbine engine. In some instances, support points 121 may be metal plates or isolation pads composed of metal, rubber, or a combination thereof. The quantity and type of support points 121 may depend on the size of the turbomachinery device. In addition, the quantity and type of support points 121 may also depend on the vibration characteristics of the turbomachinery device. For instance, support points 121 may dampen vibrations originating from the turbomachinery device. The arrangement of support points 121, generally in a rectangular grid format, may combine to provide sufficient vibrational insulation.

In certain embodiments, compressor building lower housing 106 may include a platform 122. Platform 122 may be an elevated platform designed to allow worker movement within compressor building 110.

Furthermore, compressor building lower housing 106 may also include an air handler 120. Air handler 120 may be part of a ventilation system configured to provide heating, ventilating, and air-conditioning to operations building 100. Additionally, compressor building lower housing 106 may also include a variety of piping and cabling systems to support the turbomachinery device. This may include a plurality of conduits that may extend through openings within walls of compressor building lower housing 106 and connect to outside equipment. Compressor building lower housing 106 may also include acoustic insulation features which may be required to meet local noise and performance requirements.

For another example, compressor building upper housing 107 may include features to hold or support components of the turbomachinery equipment. For instance, compressor building upper housing 107 includes an inlet duct opening 111 and an exhaust duct opening 112. Inlet duct opening 111 may be an opening in the ceiling of compressor building upper housing 107 to guide an inlet duct into compressor building upper housing 107. In some embodiments, inlet duct opening 111 is a square opening. Inlet duct opening 111 may feature a square opening ranging from 8'×8' to 10'×10'. Exhaust duct opening 112 may be another opening in the ceiling of compressor building upper housing 107, and may guide an exhaust duct into compressor building upper housing 107. In some embodiments, exhaust duct opening 112 is a square opening. Exhaust duct opening 112 may feature a square opening ranging from 8'×8' to 10'×10'. In addition, compressor building upper housing 107 may include an exoskeleton platform 113 located on top of compressor building upper housing 107. Exoskeleton platform 113 may be a rectangular grid of elongated members in which the top surface of exoskeleton platform 113 is planar. Exoskeleton platform 113 may be constructed to fit the requirements of the turbomachinery air intake and exhaust systems. Exoskeleton platform 113 may feature an outer perimeter ranging from 15'L×12'W to 30'L×17'W.

Additionally, compressor building lower housing 106 may also include a variety of piping and cabling systems to support the turbomachinery device. In some instances, compressor building upper housing 107 may be pre-assembled with certain components of the turbomachinery equipment. For example, an air inlet filter skid may be installed onto exoskeleton platform 113.

Figure 3:
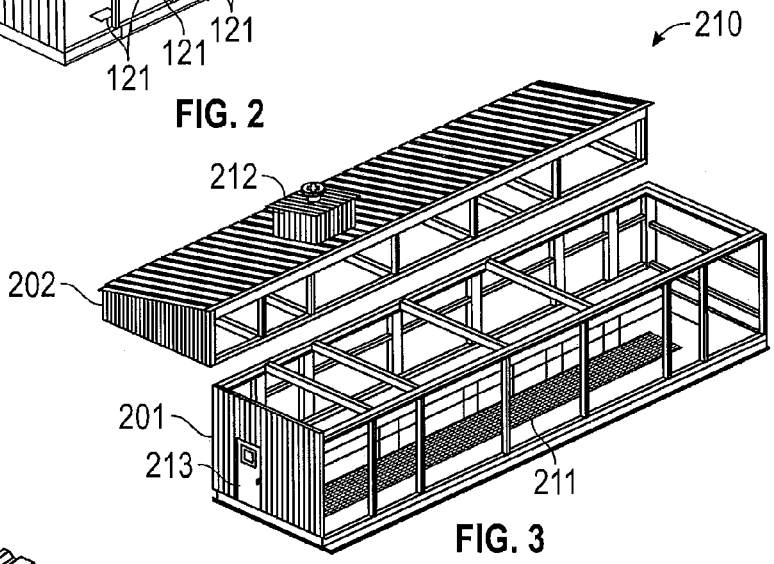
FIG. 3 is an exploded view of a maintenance building.

FIG. 3 is an exploded view of a maintenance building 210. Similar to compressor building 110, maintenance building 210 may be split into two individual substructures. Maintenance building 210 may be split into a maintenance building lower housing 201 (sometimes referred to as second lower housing) and a maintenance building upper housing 202 (sometimes referred to as second lower housing). Maintenance building lower housing 201 may be a base structure composed of panels forming at least three walls. In some embodiments, the dimensions of maintenance building lower housing 201 ranges from 35'L×12'W×12'H to 60'L×17'W×13.5'H. Maintenance building lower housing 201 may weigh from 10 short tons to 40 short tons. Further, maintenance building lower housing 201 may be built to facilitate movement of workers within maintenance building 210. Maintenance building upper housing 202 may be a roof structure composed of panels forming at least three walls in which one of the walls is a sloped ceiling. The dimensions of maintenance building upper housing 202 may range from 35'L×12'W×3'H to 60'L×17'W×7'H. In certain embodiments, maintenance building lower housing 201 and maintenance building upper housing 202 are combined to form one half of operations building 100 (shown in FIG. 1). In certain embodiments, this half of operations building 100 is referred to as the maintenance building 210 or second substructure 210.

In particular instances, maintenance building lower housing 201 and maintenance building upper housing 202 are each constructed with customizable features to accommodate maintenance of turbomachinery such as a gas turbine engine and a compressor. For instance, maintenance building lower housing 201 may feature a platform 211. Platform 211 may be a long elevated platform designed to allow worker movement within maintenance building 210. Maintenance building lower housing 201 may also feature a door 213 to provide access to maintenance building 210. Maintenance building lower housing 201 may also include material handling systems to facilitate turbomachinery maintenance activities. Additionally, maintenance building lower housing 201 may include drainage systems, building support systems such as lighting, receptacle, and access provisions, and fire and gas detection systems. All of these systems may be pre-built into maintenance building lower housing 201 to facilitate rapid field assembly during deployment.

Maintenance building upper housing 202 may feature a gas processing apparatus 212. In some instances, gas processing apparatus 212 is a vapor-liquid separator. In particular embodiments, gas processing apparatus 212 is a lube oil demister. Gas processing apparatus 212 may enhance the removal of liquid droplets entrained in a vapor stream. Gas processing apparatus 212 may be a mesh type coalescer, vane pack or other structure intended to aggregate the mist into droplets that are heavy enough to separate from the vapor stream.

Maintenance building upper housing 202 may also include material handling systems to facilitate turbomachinery maintenance activities. Additionally, maintenance building upper housing 202 may include building support systems such as lighting, receptacle, and access provisions, and fire and gas detection systems.

In certain embodiments, each substructure of operations building 100, such as compressor building lower housing 106, compressor building upper housing 107, maintenance building lower housing 201, and maintenance building upper housing 202 may not exceed dimensions of 68'L×16'W×

13.5'H and may not exceed a weight of 60 tons. In other embodiments, each substructure may not exceed dimensions of 48'L×14'W×13.5'H and may not exceed a weight of 50 tons. These limits may be defined by country, state, or municipality code.

Figure 4:
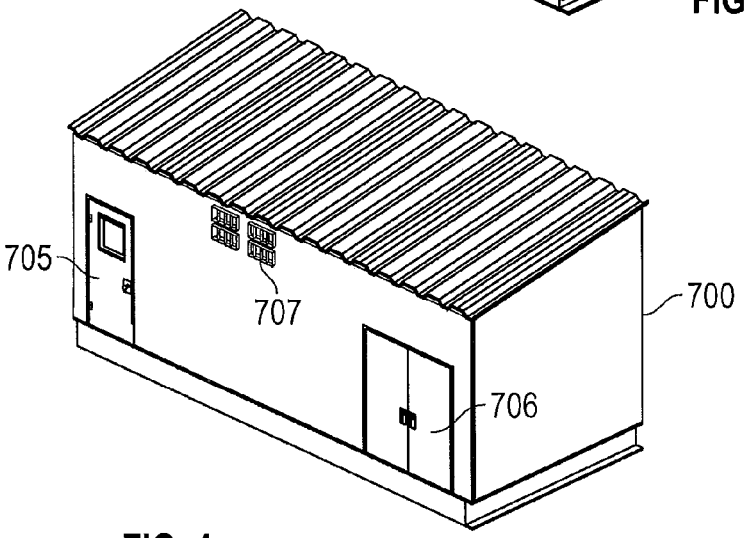
FIG. 4 is a perspective view of a local equipment room.

FIG. 4 is a perspective view of a local equipment room 700. Local equipment room ("LER") 700 may be a structure housing various control equipment and control systems. LER 700 may be pre-installed with control systems such as a fire and gas detection system, a motor control system, a lighting system, and a backup storage system. LER 700 may also feature a first door 705, a second door 706, and a plurality of vents 707.

In some embodiments, the dimensions of LER 700 range from 18'L×12'W×12'H to 60'L×15'W×13.5'H. LER 700 may weigh from 15 short tons to 60 short tons. In certain embodiments, local equipment room 700 may not exceed dimensions of 68'L×16'W×13.5'H and may not exceed a weight of 60 tons. In other embodiments, local equipment room 700 may not exceed dimensions of 48'L×14'W×13.5'H and may not exceed a weight of 50 tons. These limits may be defined by country, state, or municipality code.

Figure 5:
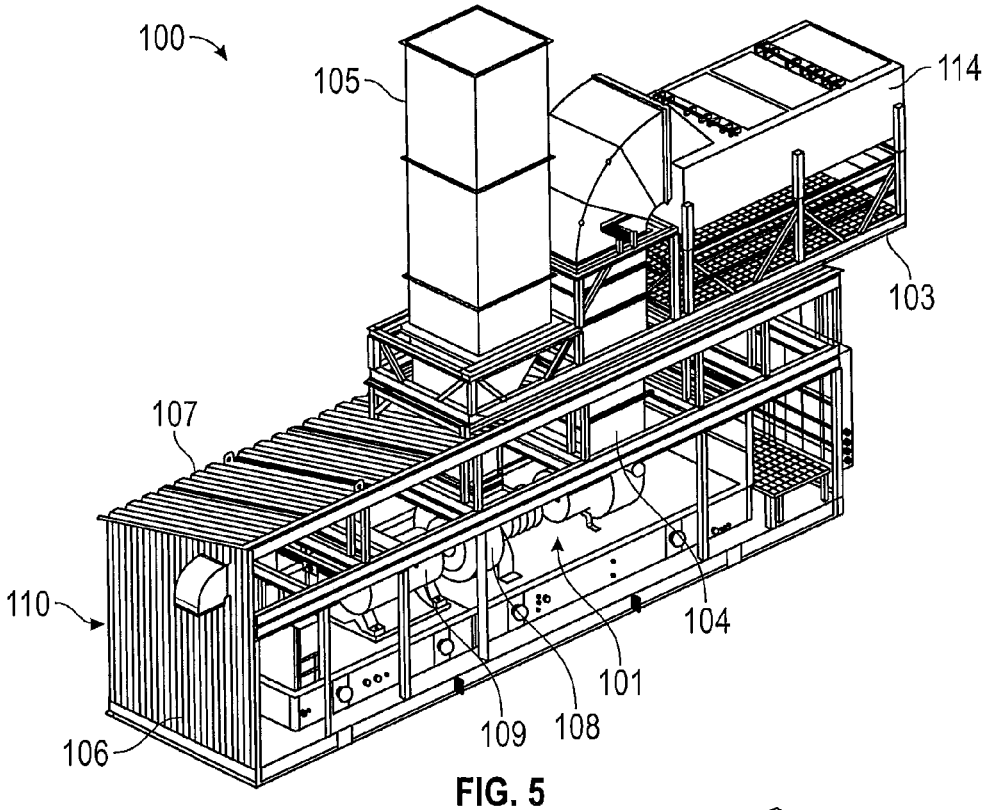
FIG. 5 is a perspective view of a compressor building fully assembled.

FIG. 5 is a perspective view of compressor building 110 fully assembled. As shown, a gas turbine package 101 may be housed within compressor building 110. Gas turbine package 101 may be comprised of a gas turbine engine 108 and a compressor 109. In some embodiments, gas turbine package 101 may be comprised of a gas turbine engine and a generator or mechanical drive apparatus. In some embodiments, gas turbine package 101 is surrounded by a separate enclosure within compressor building 110 (not shown).

In some instances, gas turbine package 101 may be assembled to compressor building lower housing 106 by aligning certain alignment features of gas turbine package 101 to support points 121 (shown in FIG. 2). For example, gas turbine package 101 may include feet or brackets that can align with support points 121. Additional components such as nuts, screws, pins, or other fasteners may be used to fasten gas turbine package 101 to compressor building lower housing 106.

In some instances, an air inlet duct 104 is coupled to gas turbine engine 108. Air inlet duct 104 may be a duct that intakes air from the outside ambient air. Air inlet duct 104 may be installed through inlet duct opening 111 (shown in FIG. 2) of compressor building upper housing 107. Similarly, an exhaust duct 105 may be coupled to gas turbine engine 108. Exhaust duct 105 may be a duct that expels exhaust gas during operation of gas turbine engine 108. Exhaust duct 105 may be installed through exhaust duct opening 112 (shown in FIG. 2) of compressor building upper housing 107.

In some instances, an air inlet filter skid 103 is assembled to the top of compressor building upper housing 107. Air inlet filter skid 103 may be a large rectangular platform to hold filters, such as air inlet filter 114. In certain embodiments, air inlet duct 104 is installed through air inlet filter skid 103. Air inlet filter 114 may be used to remove liquids or particulates before gas is compressed by the gas turbine engine.

Lube oil cooler 102 may be located adjacent one of the walls of compressor building lower housing 106 (shown in FIG. 1). In some instances, lube oil cooler 102 may be incorporated into a wall of compressor building lower housing 106. Lube oil cooler 102 may be coupled to gas turbine engine 108 through at least one interconnecting conduit. In some embodiments, lube coil cooler may act as a heat exchanger to cool fluids during the gas compression process.

Figure 6:
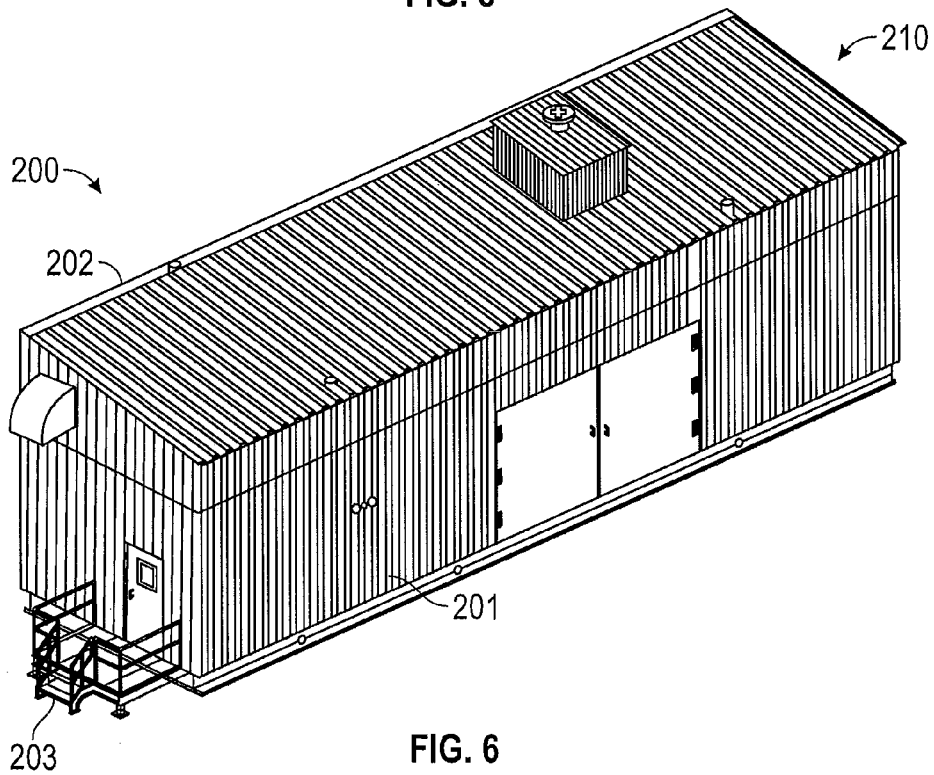
FIG. 6 is a perspective view of a maintenance building fully assembled.

FIG. 6 is a perspective view of maintenance building 210 fully assembled. As shown, a maintenance building access stairway 203 may be located adjacent one side of maintenance building 210. Maintenance building module 200 may contain equipment designed to monitor and maintain components of gas turbine package 101.

In some embodiments, compressor building 110 and maintenance building 210 are assembled together to form operations building 100 as shown in FIG. 1.

Figure 7:
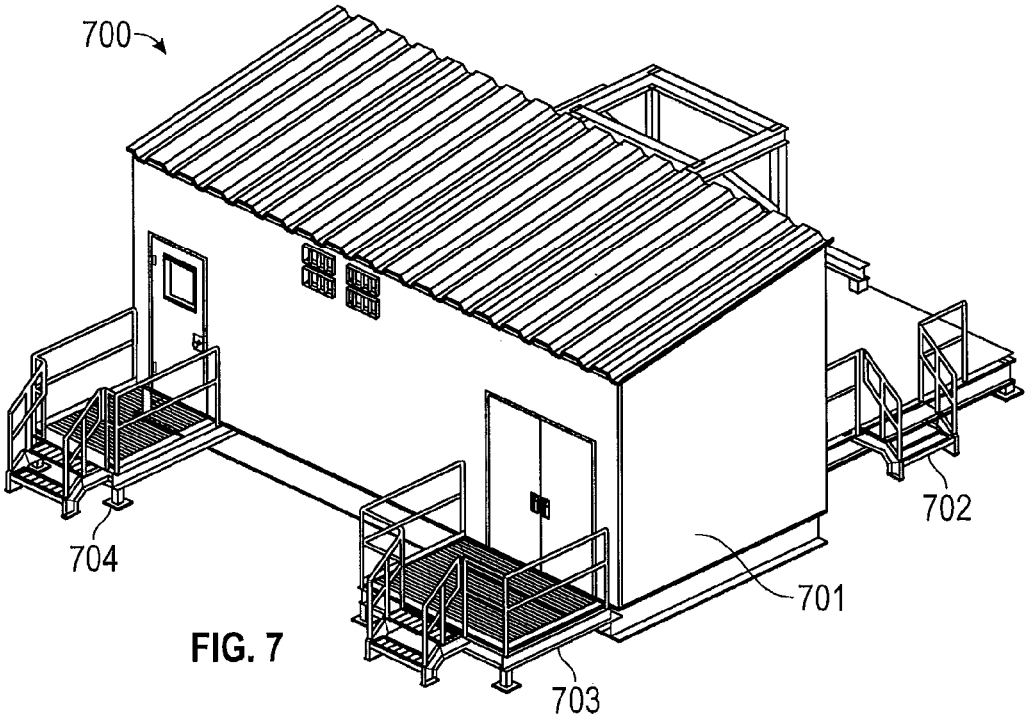
FIG. 7 is a perspective view of a local equipment room fully assembled.

FIG. 7 is a perspective view of local equipment room 700 fully assembled. As depicted, equipment room 700 may be assembled together with other structural components. For example, an access platform and cable support structure 702 may be attached to one end of equipment room 700. Access platform and cable support structure 702 may be a rectangular grid-like structure attached above a large platform. Access platform and cable support structure 702 may facilitate the connection of cabling systems between LER 700 and other structures of the modular gas compression facility 1000. In addition, a first access platform 703 and a second access platform 704 may be attached to local equipment room 700 to provide entry access to local equipment room 700.

Figure 8:
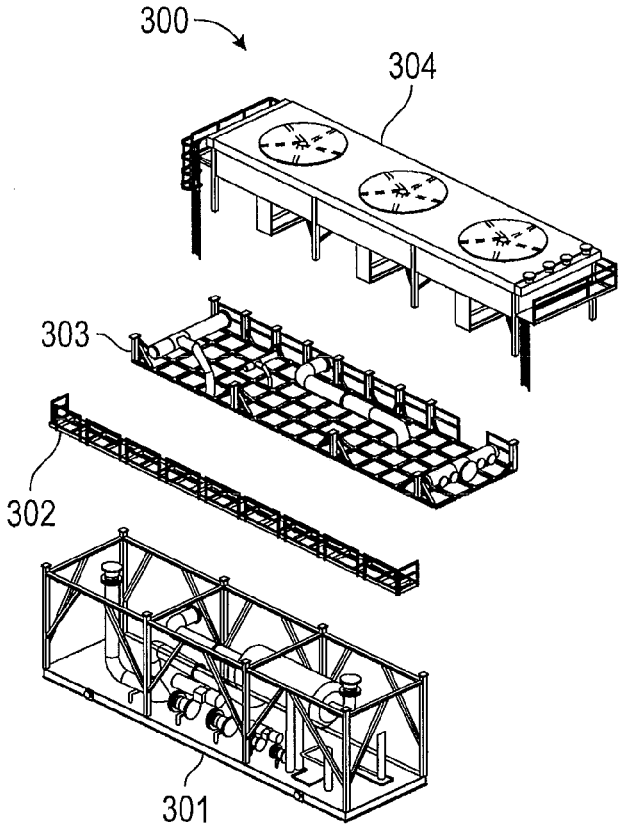
FIG. 8 is an exploded view of a gas processing structure.

FIG. 8 is an exploded view of gas processing structure 300. As shown, gas processing structure 300 may include a plurality of substructures. These substructures may include a process separation and valve skid 301, a maintenance access platform 302, an interconnecting pipe skid 303, and a process gas cooler skid 304. These substructures may be configured and sized as required to meet the scope and process requirements of the turbomachinery equipment.

In certain embodiments, each substructure of gas processing structure 300, such as process separation and valve skid 301, maintenance access platform 302, interconnecting pipe skid 303, and process gas cooler skid 304, may not exceed dimensions of 68'L×16'W×13.5'H and may not exceed a weight of 60 tons. In other embodiments, each substructure of gas processing structure 300 may not exceed dimensions of 48'L×14'W×13.5'H and may not exceed a weight of 50 tons. These limits may be defined by country, state, or municipality code.

Returning to FIG. 1, gas compression plant 1000 may include a plurality of components used to facilitate gas compression or gas delivery. In some instances, these components may be referred to as ship-loose components. For example, compressor suction pipe and rack assembly 400 may include at least one conduit assembled to at least one rack. In some embodiments, compressor suction pipe and rack assembly 400 includes a series of conduits and racks assembled together. Each conduit may be in fluid communication with gas turbine package 101. Similarly, compressor discharge pipe and rack assembly 500 may include at least one conduit assembled to at least one rack. In some embodiments, compressor discharge pipe and rack assembly 500 includes a series of conduits and racks assembled together. Each conduit may be in fluid communication with gas turbine package 101. In some instances, compressor suction pipe and rack assembly 400 and compressor discharge pipe and rack assembly 500 form a network of conduits coupling operations building 100 to gas processing structure 300.

For further example, gas compression plant 1000 includes a blowdown silencer 600 positioned near gas processing structure 300. Blowdown silencer 600 may be attached on top of a support platform 601. Blowdown silencer 600 may include a conduit coupled to gas processing structure 300. In certain embodiments, blowdown silencer 600 may expel trapped gas during emergency situations such as a gas leakage or other disturbance during operation of gas turbine package 101.

INDUSTRIAL APPLICABILITY

Gas compression plants may be used for transporting fuel from natural gas deposits through a pipeline. Frequently, natural gas deposits are located in remote areas of the planet. Constructing and deploying a gas compression plant at such a remote area may be difficult and expensive. For instance, transporting individual panels, pipes, and other construction materials may require a large amount of delivery trucks. Assembly of the gas compression plant from the individual construction materials may take a substantial amount of manpower and time. Additionally, laborers may have to travel to the remote area and sleep in special lodging facilities just to build and test the gas compression plant. These factors may lengthen the construction time for a remotely located gas compression plant.

In an embodiment of the invention, a method of deploying a modular gas compression plant may yield significant advantages. For example, constructing an operations building that houses turbomachinery equipment in four separate substructures can allow for efficient delivery and deployment. Each of the four substructures may be constructed to fit onto a transportation apparatus which can reduce the amount of total transportation required. Other large structures such as a gas processing structure may also be constructed of individual substructures. By constructing the substructures at a local site, laborers do not need to travel and stay extended periods of time at the remotely located site in order to construct the gas compression plant. All substructures may be standardized and customizable depending on the size of the gas compression plant and/or the size of the turbomachinery equipment. This can save on equipment and construction costs.

Large structures such as the operations building may be placed on a variety of different foundations. For example, the operations building may be placed on a concrete slab. In other instances, the operations building may be placed on a plurality of pilings. The pilings may be tubular members composed of metal or wood. The pilings may be installed in the ground and extend a certain height upwards from the ground. The plurality of pilings may generally be positioned in a rectangular grid like format. In certain instances, the plurality of pilings may allow greater vibrational forces to resonate through the operations building caused by the turbomachinery equipment. In these instances, certain features may aid in withstanding the vibration frequencies of the turbomachinery equipment. For example, support points 121 (shown in FIG. 2) may dampen and absorb vibrational frequencies and enhance the structural integrity of the operations building.

In addition, all components of the modular gas compression plant may be tested at a local site for functional operation. This can save time later where problems that may occur during initial testing of the fully assembled gas compression plant at the remote location are instead found at the local site. All substructures and components of the modular gas compression plant may be efficiently delivered to the remote site, deployed quickly, and seamlessly integrated together.

Figure 9:
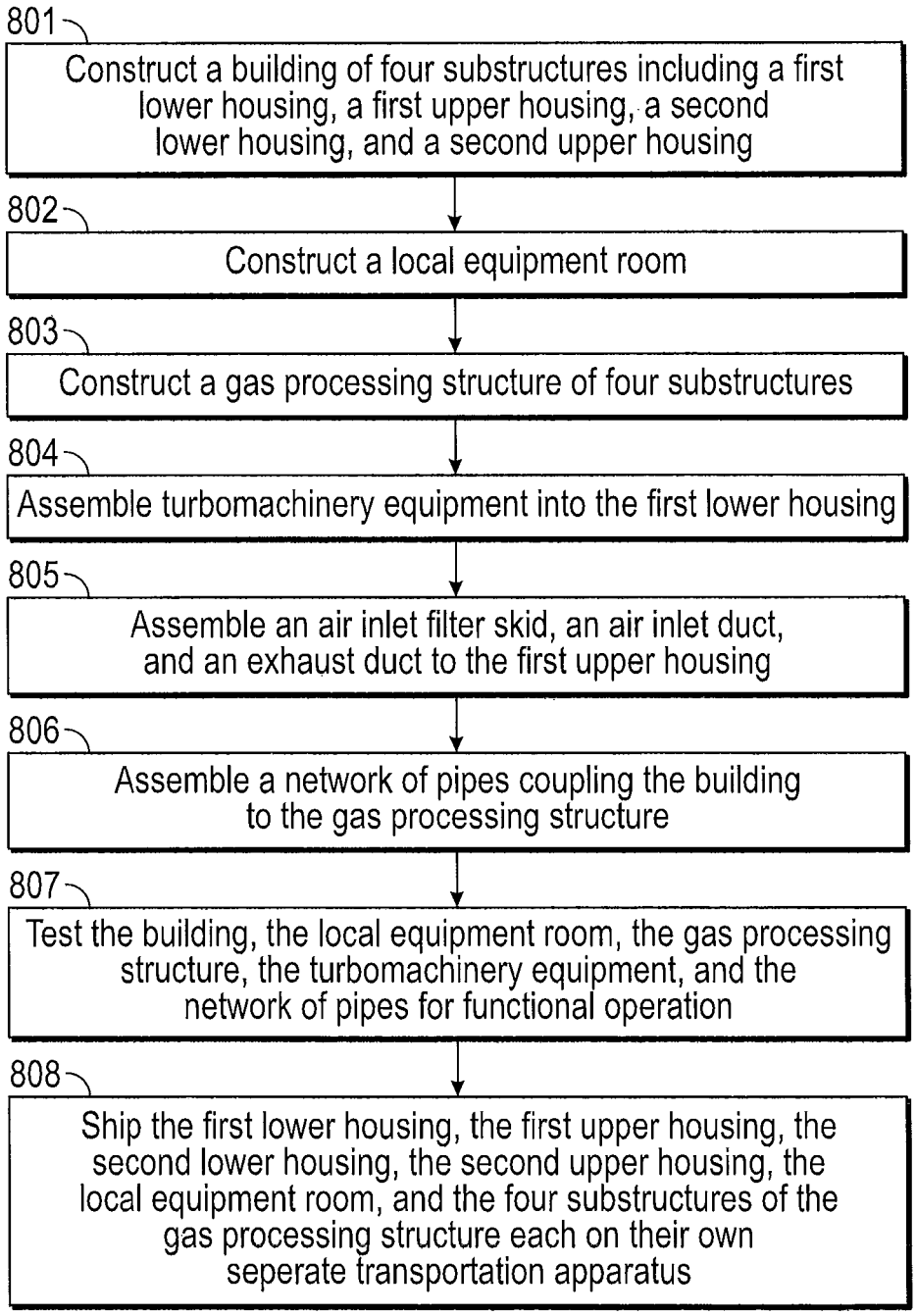
FIG. 9 is a flow chart of an embodiment of a gas compression plant construction and deployment process.

FIG. 9 is a flow chart of an embodiment of a modular gas compression plant construction and deployment method. The method may begin at Step 801 where a building is constructed of four substructures. The substructures may include a first lower housing, a first upper housing, a second lower housing, and a second upper housing. In some instances, these substructures may be referred to as a compression building lower housing, a compression building upper housing, a maintenance building lower housing, and a maintenance building upper housing. In particular embodiments, first lower housing and second lower housing are constructed to accommodate turbomachinery equipment. For example, first lower housing includes a plurality of turbomachinery equipment guide features. Some of these turbomachinery equipment guide features may include support points. First upper housing may also include a plurality of turbomachinery equipment guide features. Some of these turbomachinery equipment guide features may include an inlet duct opening, an exhaust duct opening, and/or an exoskeleton platform. Second lower housing may have a long platform located within second lower housing, and second upper housing may include a gas processing apparatus located on top of second upper housing. An example of first lower housing, first upper housing, second lower housing, and second upper housing can be found in FIG. 2 and FIG. 3.

In Step 802, a local equipment room may be constructed. Local equipment room may include a plurality of control systems. Some of these control systems may include a fire and gas detection system, a motor control system, a lighting system, and a backup storage system. An example of a local equipment room can be found in FIG. 4.

In Step 803, a gas processing structure may be constructed of four substructures. These substructures may include a process separation and valve skid, a maintenance access platform, an interconnecting pipe skid, and a process gas cooler skid. An example of a gas processing structure can be found in FIG. 8.

In Step 804, a turbomachinery equipment may be assembled into the first lower housing. In some embodiments, the turbomachinery equipment is a gas turbine engine. Additionally, the turbomachinery equipment may be coupled to a compressor. The turbomachinery equipment may be assembled into the first lower housing by aligning the turbomachinery equipment guide features with certain alignment features of the turbomachinery equipment. Nuts, screws, pins, or other fasteners may be used to fasten the turbomachinery equipment to the first lower housing. An example of a fully assembled first lower housing with turbomachinery equipment can be found in FIG. 5.

In Step 805, an air inlet filter skid, an air inlet duct, and an exhaust duct may be assembled to the first upper housing. In some instances, the air inlet filter skid, the air inlet duct, and the exhaust duct may be installed into or through the turbomachinery equipment guide features of the first upper housing. For example, air inlet duct may be installed through the inlet duct opening of the first upper housing. An example of a fully assembled first upper housing with the air inlet filter skid, the air inlet duct, and the exhaust duct can be found in FIG. 5.

In Step 806, a network of conduits may be assembled to couple the building to the gas processing structure. The network of conduits may be assembled across a plurality of racks. In addition, the network of conduits may include a compressor suction pipe and rack assembly and a compressor discharge pipe and rack assembly.

In certain embodiments, the method may include assembling other components to the building or to the gas processing structure. For example, a blowdown silencer may be connected to the gas processing structure. In addition, a lube oil cooler may be connected to the turbomachinery equipment by an intermediary conduit.

In Step 807, the gas compression plant may be tested for functional operation. For instance, the building, the local equipment room, the gas processing structure, the turbomachinery equipment, and the network of conduits may all be tested for functional operation. This may start up time of the gas compression plant due to the fact that all major components of the gas compression plant have been tested and working.

In certain embodiments, the method includes a step of disassembling the gas compression plant. Disassembly may include disassembling the building into its four separate substructures. Disassembly may also include disassembling the gas processing structure into its four separate substructures. In addition, the network of conduits may be disassembled and decoupled from the building and the gas processing structure. The network of conduits may be disassembled into individual conduit and rack subassemblies. Other miscellaneous components to be disassembled may include a blowdown silencer, a lube oil cooler, and various stairs, platforms, and trays.

In Step 808, components of gas compression plant may be shipped to a designated site. For instance, the first lower housing, the first upper housing, the second lower housing, and the second upper housing may each be loaded onto a transportation apparatus and shipped to the designated site. The transportation apparatus may be land based such as a truck. In certain embodiments, the transportation apparatus may be a barge. In particular instances, each of the substructures of the building may be separately loaded onto a transportation apparatus. Each substructure may fit onto a transportation apparatus that meets country, state, or municipality highway code. Similarly, each substructure of the gas processing structure may be separately loaded onto a transportation apparatus and shipped to the designated site. Local equipment room may also be separately loaded onto a transportation apparatus and shipped to the designated site. Various other components of the gas compression plant, such as the blowdown silencer, the lube oil cooler, and rack/pipe subassemblies can be separately loaded onto a transportation apparatus and shipped to the designated site.

In certain embodiments, the method may include a step of deploying the modular gas compression plant. Deployment of the modular gas compression plant may include unloading each substructure of the building, each substructure of the gas processing structure, the local equipment room, the network of conduits and racks, and various other components. In certain embodiments, the method may include a step of reassembling the gas compression plant at the designated site. Reassembly may include connecting the first lower housing, the first upper housing, the second lower housing, and the second upper housing together to form the building. Reassembly may also include connecting the process separation and valve skid, the maintenance access platform, the interconnecting pipe skid, and the process gas cooler skid to form the gas processing structure. In addition, reassembly may include connecting the network of conduits which couple the building and the gas processing structure. Reassembly may also include connecting the blowdown silencer to the gas processing structure, and connecting the lube oil cooler to the building.

The preceding detailed description is merely exemplary in nature and is not intended to limit the invention or the application and uses of the invention. The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

What is claimed is:

1. A method of deploying a modular gas compression plant comprising:

constructing an operations building including four substructures, the four substructures including a compressor building lower housing having a plurality of turbomachinery equipment guide features, a compressor building upper housing having a plurality of turbomachinery equipment guide features, a maintenance building lower housing having a long platform within the maintenance building lower housing, and a maintenance building upper housing having a gas processing apparatus;

constructing a local equipment room having a plurality of control systems;

constructing a gas processing structure including a process separation and valve skid, a maintenance access platform, an interconnecting pipe skid, and a process gas cooler skid;

assembling a turbomachinery equipment coupled to a compressor into the compressor building lower housing;

assembling an air inlet duct and an exhaust duct to the compressor building upper housing;

assembling a network of conduits coupling the operations building to the gas processing structure;

testing the gas compression plant for functional operation;

shipping the compressor building lower housing, the compressor building upper housing, the maintenance building lower housing, the maintenance building upper housing, the local equipment room, the process separation and valve skid, the maintenance access platform, interconnecting pipe skid, and the process gas cooler skid each on their own separate transportation apparatus.

2. The method of claim 1, further comprising deploying the compressor building lower housing, the compressor building upper housing, the maintenance building lower housing, the maintenance building upper housing, the local equipment room, the process separation and valve skid, the maintenance access platform, interconnecting pipe skid, and the process gas cooler skid at a designated site.

3. The method of claim 2, further comprising reassembling the compressor building lower housing, the compressor building upper housing, the maintenance building lower housing, the maintenance building upper housing, the local equipment room, the process separation and valve skid, the maintenance access platform, interconnecting pipe skid, the process gas cooler skid, and the network of conduits to form the gas compression plant at the designated site.

4. The method of claim 1, further comprising disassembling the operations building into the four substructures.

5. The method of claim 1, further comprising constructing a compressor building by connecting the compressor building lower housing to the compressor building upper housing.

6. The method of claim 5, further comprising constructing a maintenance building by connecting the maintenance building lower housing to the maintenance building upper housing.

7. The method of claim 6, further comprising constructing the operations building by connecting the compressor building to the maintenance building.

8. The method of claim 1, wherein the turbomachinery equipment guide features of the compressor building upper housing include an inlet duct opening, an exhaust duct opening, and an exoskeleton platform, and the gas processing apparatus of the maintenance building upper housing is a lube oil demister.

9. The method of claim 1, wherein the compressor building upper housing includes an air inlet filter skid coupled to an air inlet filter, the air inlet filter skid attached to the top of the compressor building upper housing.

10. The method of claim 1, wherein the turbomachinery equipment guide features of the compressor building lower housing include a plurality of support points.

11. The method of claim 1, wherein the compressor building lower housing and the compressor building upper housing are constructed to withstand the vibration frequencies of the turbomachinery equipment.

12. The method of claim 8, wherein the plurality of control systems of the local equipment room include a fire and gas detection system, a motor control system, a lighting system, and a backup storage system.

13. The method of claim 1, further comprising shipping and deploying a blowdown silencer, a lube oil cooler, a compressor suction pipe and rack assembly, and a compressor discharge pipe and rack assembly.

14. A method of deploying a modular natural gas compression plant comprising:

constructing a building composed of four substructures, the four substructures including a first lower housing having a plurality of turbomachinery equipment guide features, a first upper housing having a plurality of turbomachinery equipment guide features, a second lower housing having a long platform within the maintenance building lower housing, and a second upper housing having a gas processing apparatus;

constructing an equipment room having a plurality of control systems;

constructing a gas processing structure including a process separation and valve skid, a maintenance access platform, an interconnecting pipe skid, and a process gas cooler skid;

assembling a turbomachinery equipment coupled to a compressor into the first lower housing;

assembling an air inlet duct and an exhaust duct to the first upper housing;

assembling a network of conduits coupling the building to the gas processing structure; and disassembling the building into the four substructures.

15. The method of claim 12, wherein the turbomachinery equipment guide features of the first upper housing include an inlet duct opening, an exhaust duct opening, and an exoskeleton platform.

16. The method of claim 12, wherein the first upper housing includes an air inlet filter skid coupled to an air inlet filter, the air inlet filter skid attached to the top of the first upper housing.

17. The method of claim 12, wherein the turbomachinery equipment guide features of the first lower housing include a plurality of support points.

* * * * *